US005158068A

United States Patent [19]

Pickering

[11] Patent Number: 5,158,068

[45] Date of Patent: Oct. 27, 1992

[54] COOKTOP COVER APPARATUS

[75] Inventor: Mark A. Pickering, Lebanon, Ind.

[73] Assignee: Maytag Corporation, Newton, Iowa

[21] Appl. No.: 794,080

[22] Filed: Nov. 19, 1991

Related U.S. Application Data

[63] Continuation-in-part of Ser. No. 704,644, May 23, 1991.

[51] Int. Cl.[5] ..... F24C 15/10

[52] U.S. Cl. ..... 126/215; 126/211; 126/220; 108/90

[58] Field of Search ..... 126/211, 214 D, 215, 126/220, 221, 39 J; 108/90

[56] References Cited

U.S. PATENT DOCUMENTS

| | | | |
|---|---|---|---|
| D. 152,596 | 2/1949 | Covey . | |
| D. 153,977 | 5/1949 | Porter . | |
| D. 160,951 | 11/1950 | Kruck . | |
| D. 313,532 | 1/1991 | Smith | D7/363 |
| 2,411,464 | 11/1946 | Reeves | 126/39 |
| 2,536,513 | 1/1951 | O'Keefe | 126/39 |
| 2,647,990 | 4/1954 | Bury | 126/214 |
| 3,059,632 | 10/1962 | Rogers | 126/37 |
| 3,586,825 | 6/1971 | Hurley | 126/39 J |
| 4,361,132 | 11/1982 | Adkins | 126/221 |
| 4,369,763 | 1/1983 | Sullivan | 126/214 D |
| 4,634,841 | 1/1987 | Laughrey | 219/464 |
| 4,927,997 | 5/1990 | Bailey | 126/215 |

*Primary Examiner*—Carroll B. Dority

*Attorney, Agent, or Firm*—Willian, Brinks, Olds, Hofer, Gilson & Lione

[57] ABSTRACT

A cooktop cover system and apparatus having at least one cooktop cover recessed within a surrounding framework to provide a flat surface when a cooking surface positioned under the cover is not in use. The cover comprises a generally flat plate-like member with a plurality of support legs attached to the plate-like member and extending downwardly therefrom to detachably engage a rigid planar member positioned under the plate-like member. At least one of the support legs is disposed inwardly from an adjacent outer edge of the plate-like member to provide a lever arm so that downward force applied between the inwardly disposed support leg and the adjacent outer edge of the plate-like member pivots the cooktop cover and raises the opposite edge to allow removal of the cover.

14 Claims, 3 Drawing Sheets

COOKTOP COVER APPARATUS

CROSS-REFERENCE TO RELATED APPLICATIONS

This application is a continuation-in-part of pending design patent application Ser. No. 07/704,644 filed May 23, 1991.

FIELD OF THE INVENTION

This invention relates to countertop cooking apparatus, and more particularly, relates to a countertop cooking apparatus having at least one recessed cooktop cover which is easily removable without handles or knobs, forms a generally flat decorative surface area when in place above a recessed cooking surface and has dual functions.

BACKGROUND OF THE INVENTION

Providing covers for the cooking surfaces of cooking ranges, is not new in the art. Reeves U.S. Pat. No. 2,411,464; O'Keefe U.S. Pat. No. 2,536,513; Bury U.S. Pat. No. 2,647,990; and Rogers U.S. Pat. No. 3,059,632 illustrate cooking stoves with hinged covers for their cooking surfaces. The covers are large and bulky and do not appear to provide any function when the cooking surfaces are being used.

Covey U.S.D. Pat. No. 152,596; Porter U.S.D. Pat. No. 153,977; and Kruck U.S.D. Pat. No. 160,951 illustrate modular cooktop covers for the cooking surfaces of a cooking stove which are disposed above the plane of the cooking surface and provide edges that an operator can grasp for removal of the cover.

Adkins U.S. Pat. No. 4,361,132 and U.S.D. Pat. No. 313,532 disclose modular covers for cooking apparatus which are both disposed above the plane of the cooking surface and have handles and knobs so that an operator can remove the covers.

SUMMARY OF THE INVENTION

This invention provides a novel countertop cooking apparatus with a cooktop cover which is decorative while providing dual functionality. A cooktop cover of the invention is recessed within a surrounding framework to provide a flat upper surface that is generally level with the top of a surrounding framework when an underlying cooking unit is not in use. The cover comprises a generally flat plate-like member with a support means extending downwardly therefrom to detachably engage a rigid support member positioned under the plate-like member of the cover. The cover support means is disposed inwardly from an adjacent outer edge of the plate-like member to provide a lever arm so that downward force applied between the inwardly disposed support means and the adjacent outer edge of the plate-like member raises the opposite edge of the cover to provide a handhold for removal of the recessed cover.

BEST MODE FOR CARRYING OUT THE INVENTION

Figure 1:
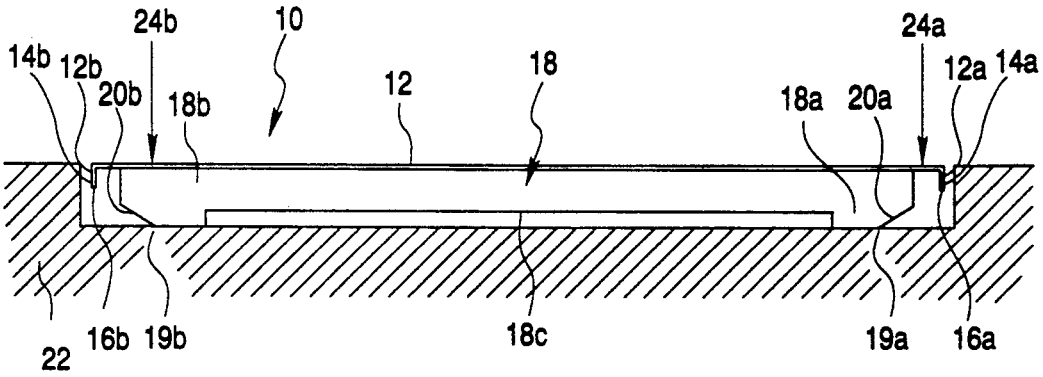
FIG. 1 is a partial cross-sectional side view of one embodiment of the cooktop cover apparatus.
Figure 2:
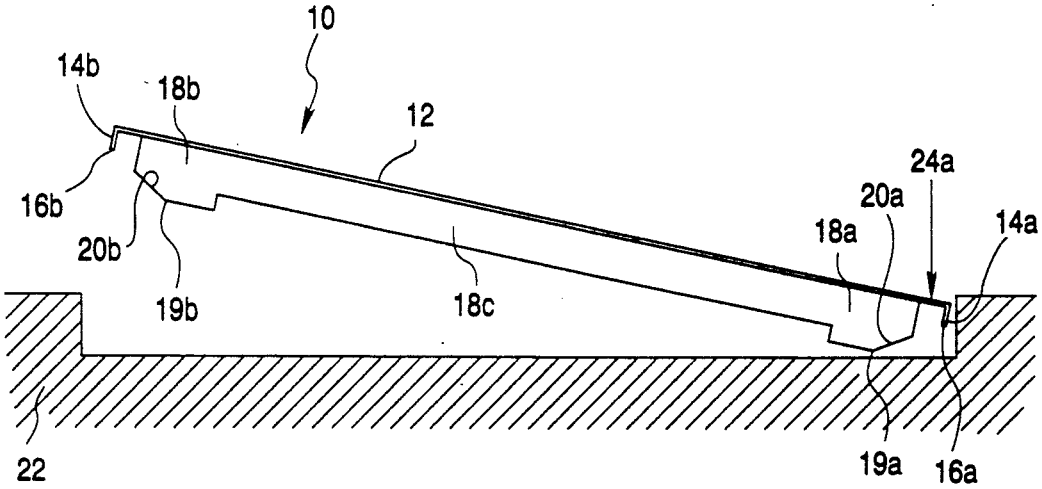
FIG. 2 is the partial cross-sectional side view of FIG. 1 with the cooktop cover apparatus raised at one side to assist its removal.

FIGS. 1 and 2 illustrate a cover apparatus of the invention and its operation. For convenience and illustration, the reference numbers in FIGS. 1 and 2 include the letter a for elements on the right side of FIG. 1 and the letter b for elements on the left side of FIG. 1. It will be understood, however, that elements indicated with the same reference number that include an a or b suffix are the same element in the embodiment shown.

A cooktop cover 10 comprises a generally flat plate-like member 12 which is disposed above and generally recessed in a rigid member 22. Support means 18, including the two ends 18*a* and 18*b* of legs 18*c*, is rigidly fastened to and extends downwardly from the bottom surface of plate-like member 12. The height of support means 18 is such that the cover 10 can be recessed in and provide an upper surface that is level with a surrounding environment. At least a portion of the support means 18, such as one end (18*a* or 18*b*) of the leg 18*c*, is positioned inwardly from an adjacent outer edge (12*a* or 12*b*) of plate-like member 12 to provide a pivot (19*a* or 19*b*) about which the cooktop cover 10 can be pivoted.

In the embodiment shown in FIGS. 1 and 2, leg 18*c* of support means 18 has been provided with beveled lower surfaces 20*a* and 20*b* at each of its ends 18*a* and 18*b* to facilitate pivoting of cooktop cover 10, but such beveled ends are not necessary to this invention. When downward force is applied, for example, between the inwardly disposed end 18*a* of support means 18 and the adjacent outer edge 12*a* at force-receiving location 24*a*, a lever arm is formed by the plate-like member 12 and the pivot 19*a*, permitting the opposite side of the cover 10 to be raised, as shown in FIG. 2.

Figure 3:
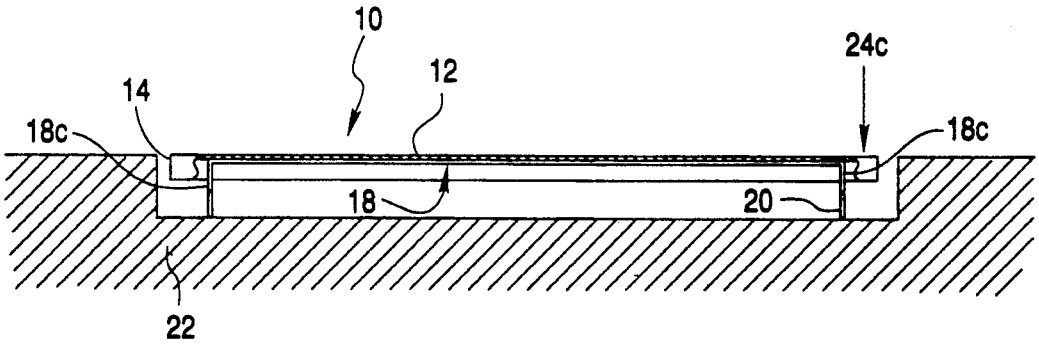
FIG. 3 is a partial cross-sectional end view of the cooktop cover apparatus of FIG. 1 at right angles from FIG. 1.

FIGS. 1 and 2 illustrate pivoting of a cooktop cover 10 adjacent a beveled surface 20*a* that is spaced inwardly from the outer edges 12*a* of plate-like member 12. As shown in FIG. 3, however, force 24 applied to any edge of the cover 10 will lift the opposite side, and the presence of beveled surfaces 20*a* and 20*b* are only to facilitate operation of this disclosed embodiment and are not necessary to carry out the invention. In addition, support means 18 can include different numbers of supports. For example, four support legs can be positioned inwardly from the corner portions of plate-like member 12. If four support legs are used, downward force exerted on any given edge of plate-like member 12 will also cause the cooktop cover 10 to pivot about one or more of the support legs adjacent to the location of downward force and thereby allow removal of the cooktop cover 10.

The exact position of force receiving locations 24*a* and 24*b*, shown in FIG. 1, and 24*c* shown in FIG. 3, is not important as force can be applied generally at any location between an inwardly-spaced support and an edge of the cover; the closer the force is, however, to the outer edge of the cover, the less force will be required to pivot cooktop cover 10 about its support means 18.

If optional downwardly extending flanges 14 are provided, as shown in FIGS. 1-3, the distance between the lower edge 16*a*, 16*b* of flange 14 and the underlying support member 22 must be sufficiently large to permit adequate vertical movement of the opposite side of the cover to permit the edge of the cover to be gripped for removal of the cover 10. For example, if downward pressure is exerted at location 24*a* causing the flat plate-like member 12 to rotate about pivot 19*a* at support end 18*a*, the bottom edge 16*a* of flange 14*a* may contact the underlying support member 22 and limit the rotation of plate-like member 12; but as shown in FIG. 2, the opposite edge 14*b* of the cover 12 may be raised a substantial distance if proper clearance is provided between the bottom edge 16*a* of flange 14*a* and underlying support member 22. The distance between the bottom of the edge of cover 10 and the underlying support member 22 must be, in any event, sufficiently large to permit plate-like member 12 to pivot about its support means 18 and permit an operator to reach under its bottom edge and remove the cover 10.

Figure 4:
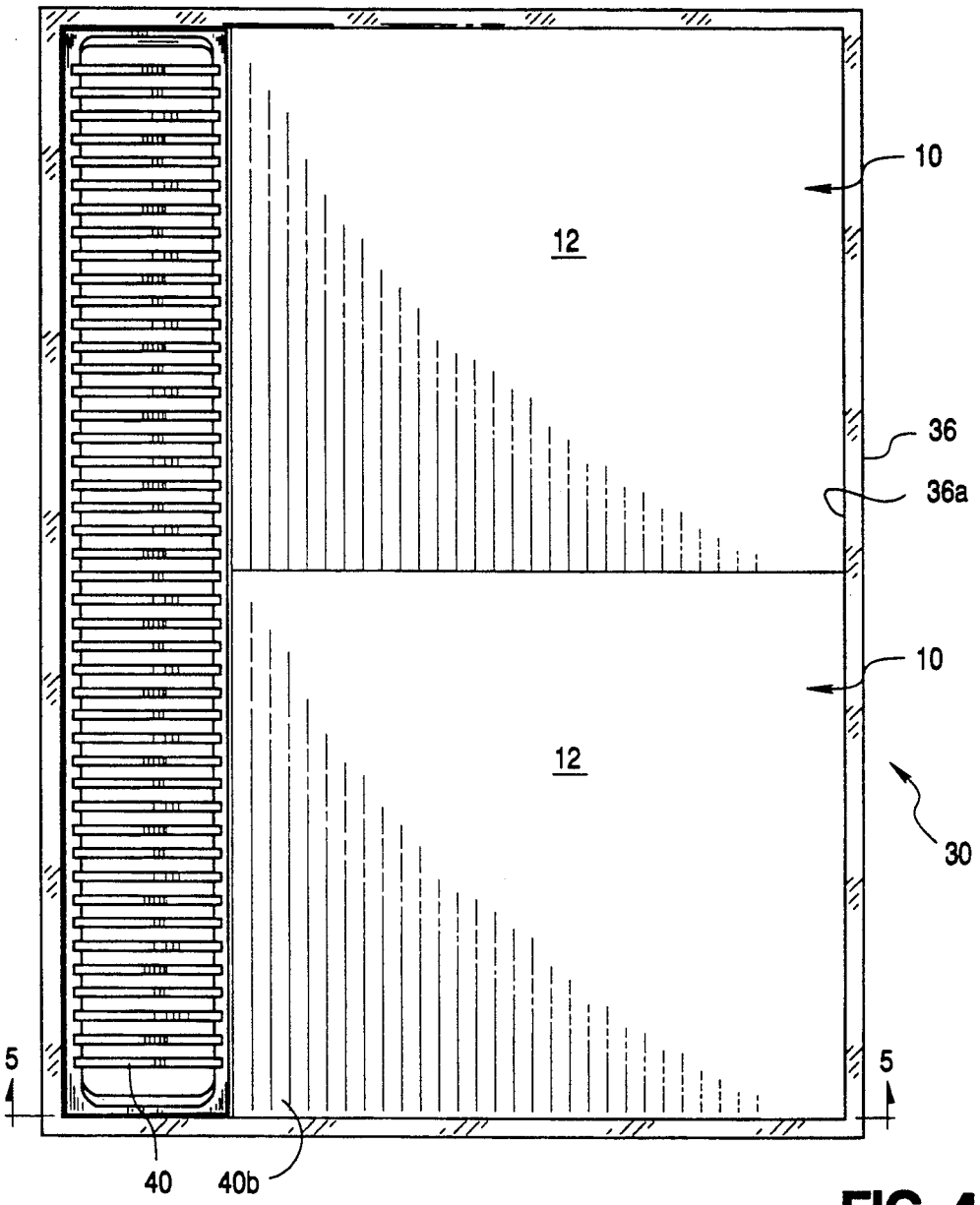
FIG. 4 shows a top view of a modularized cooktop system using cooktop cover apparatus of the invention.
Figure 5:
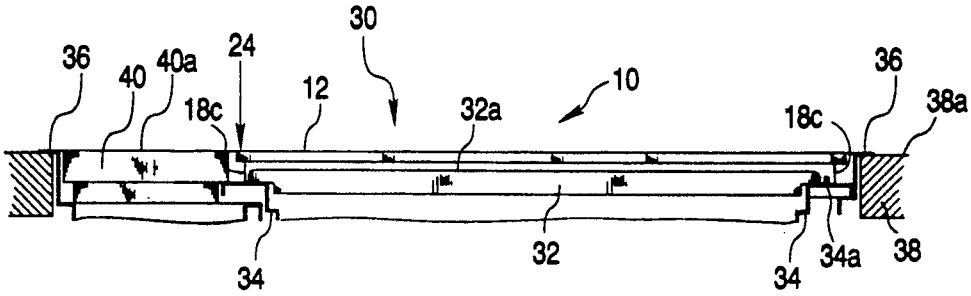
FIG. 5 is a partial cross-sectional view of a cooktop cover apparatus of FIG. 4 taken at plane 5—5 of FIG. 4.
Figure 6:
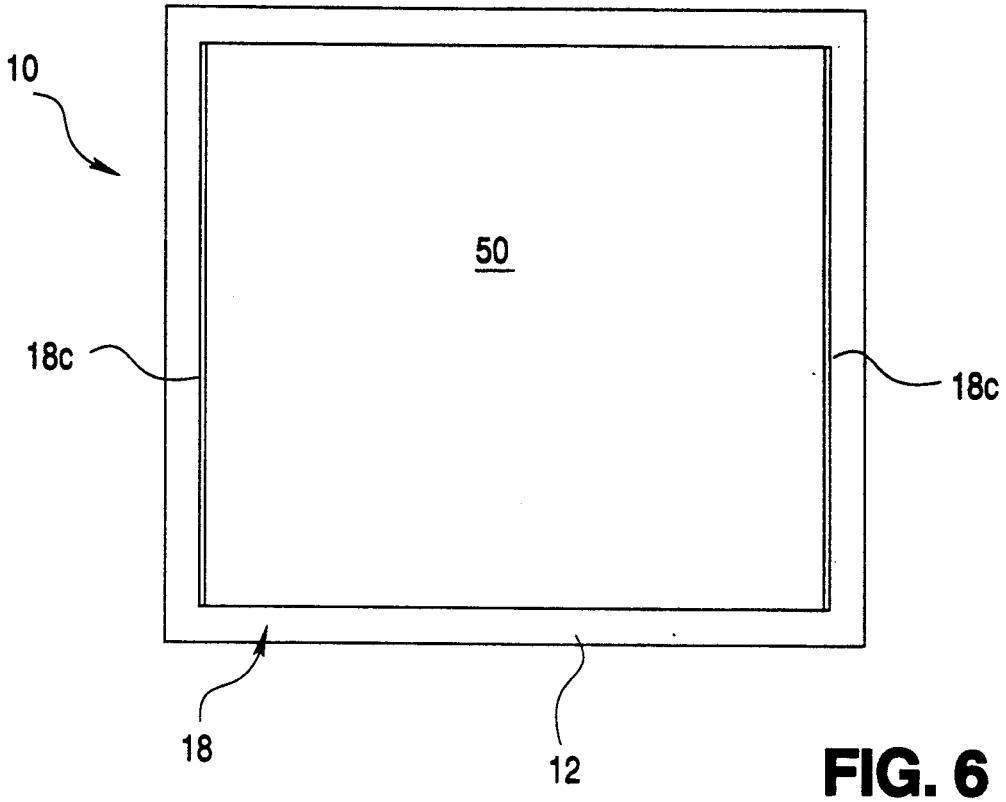
FIG. 6 shows a bottom view of the cooktop cover of FIG. 4.

FIGS. 4-6 illustrate a countertop cooking apparatus 30 generally comprising two preferred cooktop covers 10, one or more recessed cooking units 32, a framework 36 with an inner edge 36*a*, an optional drip pan 34 and optional ventilation inlet 40.

An upper surface 32*a* of a recessed cooking unit 32 is recessed below the upper surface 38*a* of a horizontal system-supporting surface 38, which in the embodiment shown comprises a counter top. Conventional control means, not shown, can be used to control the operation of recessed cooking unit 32. Below the recessed cooking unit 32 is a drip pan 34 (which is not a necessary part of this invention) for collection of grease, boilovers and other residues formed during cooking. The cooking apparatus 30 has a surrounding framework 36, which cooperates with cooktop covers 10 and provides decorative trim disposed at the upper periphery of the cooking apparatus 30. The framework 36 rests on the upper surface 38*a* of a counter top 38 as a result of gravitational force. Fasteners or adhesive may also be used to ensure stationary contact between framework 36 and upper surface 38*a*.

Disposed adjacent to one edge of each of the covers 10 is a ventilation inlet 40 (which is not a necessary part of this invention) having an upper surface 40*a* which is generally level with the upper surfaces of the covers 10 and the framework 36, as shown in FIGS. 4 and 5. Ventilation inlet 40 permits the removal of cooking odors, steam, and the like, formed during use of the recessed cooking unit 32 by a downdraft ventilation system.

As shown in FIGS. 4 and 5, the two cooktop covers 10 of the invention are disposed above the recessed cooking unit 32 but are recessed in the framework 36 to provide a level and smooth upper surface for the cooking apparatus 30. Each cooktop cover 10 of FIGS. 4-6 includes an upper plate-like member 12, which is preferably Pyrex brand glass or Lexan or the like, providing a smooth decorative glasslike upper surface. Such a level and smooth upper surface is easily cleaned and very decorative as shown in FIG. 4. As shown in FIG. 6, the preferred support means 18 of the cover 10 comprises a flat metal plate 50 having its two opposite sides turned downwardly to provide two support legs 18*c* extending along the opposite sides of plate-like member 12. The support means 18 is fastened underneath plate-like member 12 by adhesive. The two support legs 18*c* extend along two sides of cover 10 and contact a rigid planar upper surface 34*a* of the drip pan 34 (or any other underlying support member) and are disposed outwardly of the upper surface 32*a* of recessed cooking unit 32 but inwardly of the outer edge of cover 10.

As shown in FIGS. 4 and 5, the clearance between the outer edges of cooktop covers 10 and the inner edges 36*a* and 40*b* of framework 36 and ventilation inlet 40, respectively, can be very close to prevent materials from falling through the interfacing space and to provide a very decorative appearance. Moreover, the upper surface of plate-like members 12 are substantially level with ventilation inlet 40, framework 36 and counter top 38. Thus, with cooktop covers 10 in place on cooking apparatus 30, a substantially flat surface is formed which not only provides an eye-appealing cooking system, but also provides a convenient work surface and protects the recessed cooking unit 32 from damage while not in use.

If a user desires to use the recessed cooking unit 32, the user can press one of the edges of a cover 10. The cooktop cover 10 will pivot about legs 18*c* of support 18 or the ends thereof, adjacent to the location of downward force in the manner shown and described above in FIGS. 1-3, and the user can grasp the edge of cooktop cover 10 for removal at the edge opposite to the location where downward force was applied. As described above, the cooktop cover 10 pivots sufficiently to provide enough clearance so that an operator can grasp the cooktop cover 10 with his fingers between an outside edge of the cover and inner edges 36*a* and 40*b*.

In the embodiment shown in FIGS. 4-6, the cooking apparatus 30 includes two cooktop covers 10 which are recessed within the framework 36 above recessed cooking units 32, shown in FIG. 5. Either one or both of the cooktop covers 10 can be removed to provide access to and operation of one or both of the recessed cooking units 32.

Figure 7:
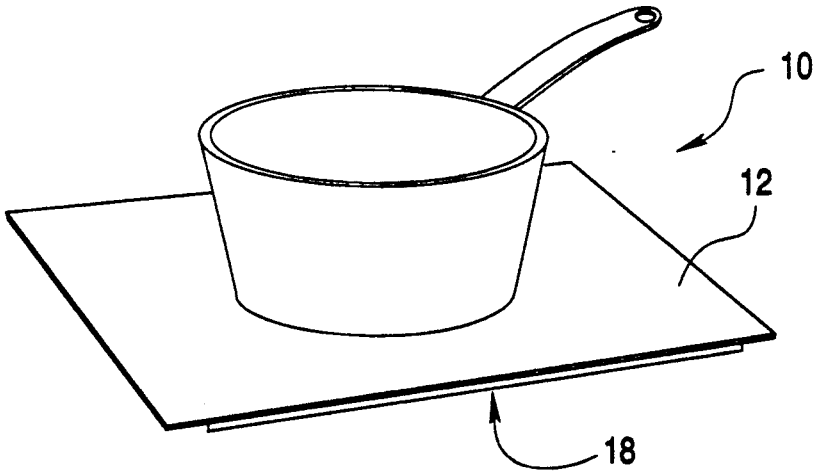
FIG. 7 is a perspective view of a cover of the invention in use as a trivet.

The cooktop covers 10 are preferably formed of a heat resistant material, such as Pyrex glass (trademark of Corning Glass Works) or ceramic material, having sufficient physical properties to allow the cooktop covers 10, when removed from above the recessed cooking surfaces 32, to be used as a trivet for supporting hot cookware, as shown in FIG. 7. Optionally, the cooktop covers 10 can be formed of a thermally insulating and cut resistant material allowing its use as both a trivet and as a cutting board. The cooktop covers 10 can also be formed from sheet metal and can be provided with flanges and decorative coatings, such as porcelain enamel.

While the preceding description illustrates the presently known best mode for carrying out the invention, the scope of this invention is not limited, as will be apparent to those skilled in the art, to the described best mode and is limited only by the scope of the invention, following claims and the prior art.

I claim:

1. A cover for a cooking surface recessed below the upper surface of a cooktop unit, comprising: a generally flat plate-like member substantially overlying said recessed cooking surface; and support means having a first end secured to said plate-like member and a second end engageable with said cooking surface for supporting said flat plate-like member above said cooking surface and recessed within the cooktop unit, said support means being secured to said plate-like member inwardly of an adjacent outer edge thereof to provide a lever arm whereby downward force applied adjacent said outer edge of said plate-like member outwardly of said support means pivots said plate-like member to raise an opposite edge for providing a handhold to remove the cover form said recessed cooking surface.

2. The cover of claim 1 wherein said support means has a beveled surface extending from the outer edge of said second end in a direction generally towards the adjacent outer edge of said plate-like member.

3. The cover of claim 1 wherein said support means comprises two support means, each being disposed inwardly from the outer edges at opposite sides of said plate-like member.

4. The cover of claim 1 wherein said support means comprises a plurality of support legs disposed inwardly from the adjacent edges of said plate-like member.

5. The cover of claim 1 wherein said cover is adapted to provide a trivet when said cover is removed from said recessed cooking surface.

6. The cover of claim 1 wherein said generally flat plate-like member provides a cutting board when said cover is removed from said recessed cooking surface.

7. A cooktop cover system, comprising:

a cooktop unit having at least one recessed cooking surface, said at least one cooking surface being recessed within a framework; and at least one cover recessed within said framework, said cover comprising a generally flat plate-like member substantially overlying said at least one recessed cooking surface and being recessed within the boundaries of said framework, and support means having a first end secured to said flat plate-like member and a second end engageable with said cooktop unit for supporting said flat plate-like member above said cooking surface but recessed within said framework, said support means being secured to said plate-like member inwardly of an adjacent outer edge thereof to provide a lever arm so that downward force applied at the adjacent outer edge of said plate-like member raises an opposite edge for providing a handhold to remove the cover from said recessed cooking surface.

8. The cooktop cover system of claim 7 further comprising a ventilation means for removing cooking vapors and steam from the operating environment.

9. The cooktop cover system of claim 7 further comprising a drip pan positioned below said at least one cooking surface for collecting grease and other undesirable substances.

10. The cooktop cover system of claim 7 wherein the upper surfaces of said framework and plate-like member in said recess are substantially coplanar with a surrounding countertop in which said system is installed.

11. The cooktop cover system of claim 7 wherein said support means comprises two supports extending along two outer edges of the plate-like member but spaced inwardly thereof.

12. The cooktop cover system of claim 11 wherein said plate-like member is a high temperature glass rectangle and said two supports comprise the outer downwardly turned edges of a metal plate fastened below said high temperature glass rectangle.

13. A decorative cover for a working surface recessed within an appliance, comprising:

a light-weight plate having a decorative upper surface to cover the recessed working surface; and support means for said light-weight plate, said support means engaging said appliance, locating said light-weight plate above said recessed working surface but recessed within the upper surface of said appliance, and providing a lever arm between an outer edge of said plate and said appliance to permit the cover to be lifted from the appliance with the application of pressure adjacent an outer edge.

14. The cover of claim 13 wherein said decorative cover is heat resistant and adapted for use as a trivet when removed from said appliance.

* * * * *